US006546831B2

(12) United States Patent
So

(10) Patent No.: US 6,546,831 B2
(45) Date of Patent: Apr. 15, 2003

(54) CORK REMOVER

(76) Inventor: Kwok Kuen So, 2nd Floor, Chuan Yuan Factory Building, 342-344 Kwun Tong Road, Kwun Tong, Kowloon (HK)

( * ) Notice: Subject to any disclaimer, the term of this patent is extended or adjusted under 35 U.S.C. 154(b) by 0 days.

(21) Appl. No.: 10/075,401

(22) Filed: Feb. 15, 2002

(65) Prior Publication Data

US 2003/0041695 A1 Mar. 6, 2003

(30) Foreign Application Priority Data

Sep. 6, 2001 (GB) ..... 0121607

(51) Int. Cl.[7] ..... B67B 7/04
(52) U.S. Cl. ..... 81/3.48; 81/3.29
(58) Field of Search ..... 81/3.29, 3.45, 81/3.48, 3.35, 3.36, 3.39, 3.49

(56) References Cited

U.S. PATENT DOCUMENTS 4,374,464 A * 2/1983 Tillander ..... 81/3.48
4,637,283 A * 1/1987 Bertram et al. ..... 81/3.29
4,765,206 A * 8/1988 Poehlmann ..... 81/3.29
4,947,711 A * 8/1990 Giebeler ..... 81/3.29
D429,981 S 8/2000 So
D453,456 S 2/2002 So
6,431,028 B2 8/2002 So

FOREIGN PATENT DOCUMENTS

EP 928 771 7/1999
JP 9-309591 12/1997

* cited by examiner

*Primary Examiner*—D. S. Meislin
(74) *Attorney, Agent, or Firm*—Leydig, Voit & Mayer, Ltd.

(57) ABSTRACT

A cork remover for removing the cork of a bottle includes a tubular body having upper and lower ends, a helical corkscrew insertable into the body through its upper end for rotation within and relative to the body, and a handle connected at an upper end of the corkscrew for rotating the corkscrew. The body includes resiliently deformable, frictionally gripping annular abutments located within the body between the upper and lower ends for engagement of the rim portion of the mouth of a bottle, while the cork is being removed by rotation of the corkscrew.

12 Claims, 3 Drawing Sheets

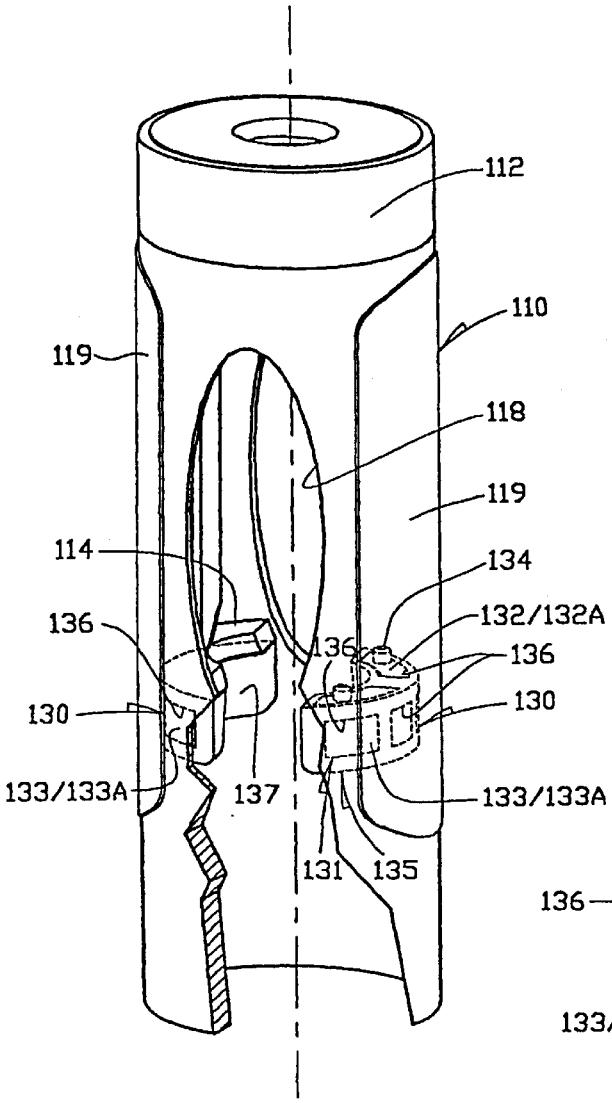
FIG. 3
FIG. 4A
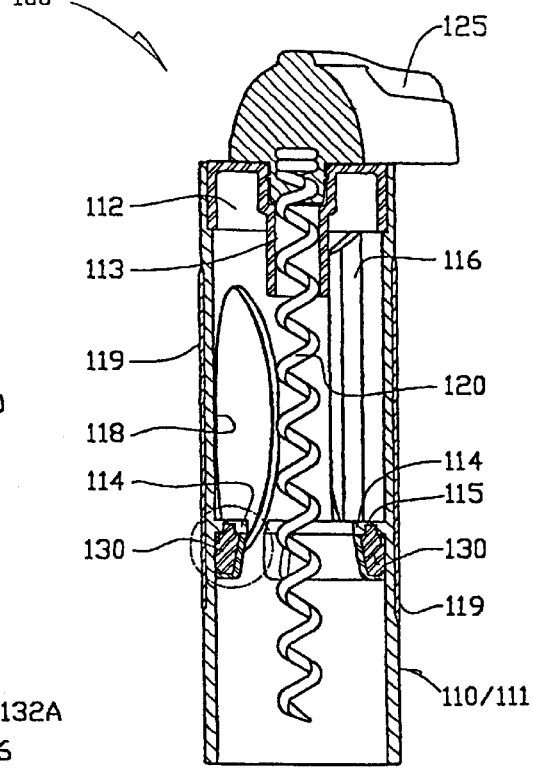
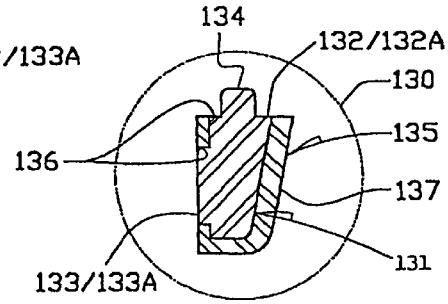
FIG. 4B

CORK REMOVER

The present invention relates to a device for removing the cork of a bottle of wine, spirits, liqueur or the like.

BACKGROUND OF THE INVENTION

Different types of cork removers are known, which in the majority of cases incorporate a corkscrew. In the general type concerned, the cork remover has a body supporting a corkscrew for rotation. While the corkscrew is being rotated into the cork, it is necessary for the user to hold the remover body still or against rotation relative to the bottle. In one example, the remover body may comprise a pair of pivotably connected handles for in use clamping the neck of the bottle.

In another example, which belongs to the specific type of cork removers concerned, the body is tubular for enclosing the neck of the bottle and does not have any moving parts to clamp or grip the bottle neck. The user is therefore required to grasp both the remover body and the part of bottle immediately outside the remover body with one hand to hold the remover body still, while his other hand is turning the corkscrew. As the engagement between the remover body and the bottle is often not stable, slipping may occur, which is undesirable.

The invention seeks to mitigate or at least alleviate such a problem by providing an improved cork remover.

SUMMARY OF THE INVENTION

According to the invention, there is provided a cork remover for removing the cork of a bottle, comprising a tubular body having upper and lower ends, a helical corkscrew insertable into the body through its upper end for rotation within and relative to the body, and a handle connected at an upper end of the corkscrew for rotating the corkscrew. The body includes resiliently deformable, frictionally gripping abutment means located and arranged in a substantially annular manner on a radial plane within the body between its upper and lower ends for engagement by the rim portion of the mouth of said bottle, while said cork is being removed by the corkscrew upon rotation.

Preferably, said abutment ,means comprises a relatively rigid inner part connected to the body and a resiliently deformable outer part for engagement by said rim portion.

More preferably, the inner part of said abutment means is in the form of a core, and the outer part is in the form of a jacket enclosing the core.

Further more preferably, the jacket is formed with at least one aperture exposing a part or a respective part of the core, said exposed part being connected with the body.

Further more preferably, the exposed part of the core is connected with the body by glue or ultrasonic welding.

It is preferred that the surface of the exposed part of the core lies substantially flush with the surface of the jacket around its aperture.

It is preferred that the exposed part of the core includes a protrusion inserted into a hole or recess of the body.

In a preferred embodiment, the body has a tubular wall and includes an integrally formed flange extending radially from the inner surface of the wall to form a lower internal corner therewith, and said abutment means is located within the corner.

More preferably, said abutment means is connected to both the lower surface of the flange and the inner surface of the body.

It is preferred that said abutment means has a substantially annular inner surface that tapers upwards.

It is further preferred that the inner surface of said abutment means is substantially part-conical.

In a first specific construction, said abutment means comprises a pair of opposed arcuate members.

In a second specific construction, said abutment means comprises a single ring member.

It is preferred that said abutment means is made, at least partially, of rubber material.

It is preferred that the outer part or jacket of said abutment means is made of rubber material.

BRIEF DESCRIPTION OF DRAWINGS

The invention will now be more particularly described, by way of example only, with reference to the accompanying drawings, in which:

FIG. 3 is an enlarged perspective view corresponding to FIG. 2, showing how the abutment members are located within the cork remover;

FIG. 4A is a cross-sectional side view of the cork remover of FIG. 3, and FIG. 4B shows in greater detail how the abutment members are located;

DETAILED DESCRIPTION OF PREFERRED EMBODIMENT

Figure 1:
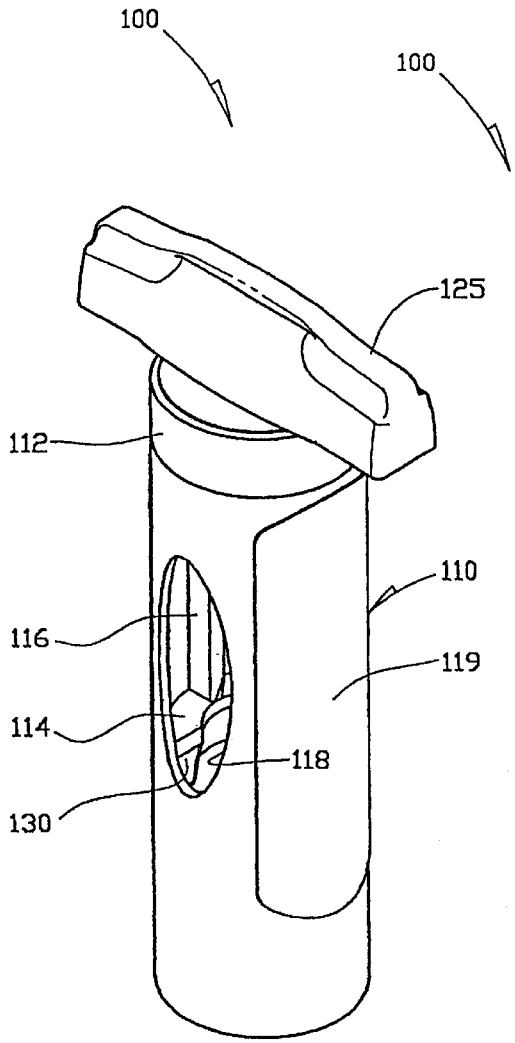
FIG. 1 is a perspective view of an embodiment of a wine cork remover in accordance with the invention.
Figure 2:
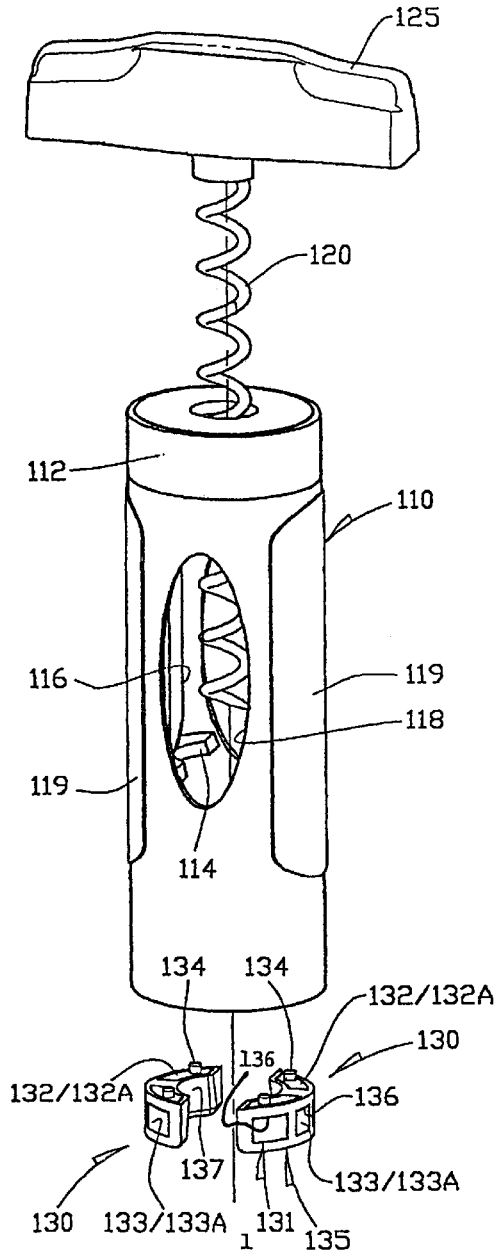
FIG. 2 is a perspective view of the cork remover corresponding to FIG. 1, showing a corkscrew thereof with an associated turning handle and a pair of abutment members in isolation.
Figure 5:
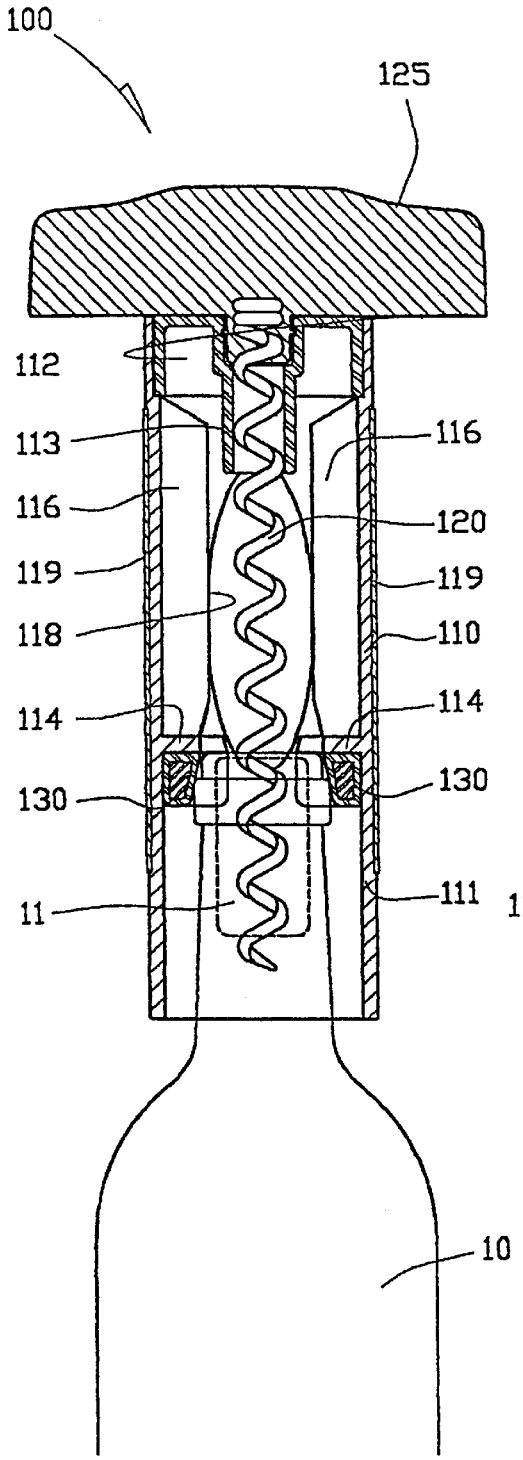
FIG. 5 is a cross-sectional side view of the cork remover of FIG. 1, shown in use on a wine bottle.

Referring initially to FIGS. 1 to 5 of the drawings, there is shown a wine bottle cork remover 100 embodying the invention. The cork remover 100 comprises an upright plastic tubular body 110, a metal helical corkscrew 120 insertable co-axially into the body 110, and a plastic turning handle 125 connected across the upper end of the corkscrew 120. The body 110 includes a cylindrical wall 111 having an upper end that is closed by a circular end piece 112. The end piece 112 includes a central circular aperture and a tube 113 depending integrally therefrom, through which the corkscrew 120 can be inserted into or withdrawn from the body 110 in a guided manner.

The remover body 110 integrally includes, on the inner surface of the its wall 111, a pair of opposed arcuate flanges 114 lying in a radial plane between the upper and lower ends of the body 110 and a pair of opposed straight blades 116 lying on an axial plane. The two flanges 114 together act as an annular abutment to hold a wine bottle 10 by the rim and/or the rim's outer surface (collectively the rim portion) of its mouth, while the corkscrew 120 is being rotated clockwise to remove a cork 11 from the bottle 10 between the flanges 114. The blades 116, which extend upwards from the flanges 114 to reach the end piece 112, hold the cork 11 being removed against rotation by the corkscrew 120.

The remover body 110 includes a pair of oblong openings 118 passing through opposite sides of the wall 111 to permit access to the interior, and, in particular, the space between the two blades 116 where a removed cork may be trapped. A pair of rubber handgrip pads 119 is attached to the body 110, on opposite sides thereof and between the two openings 118.

The cork remover 100 includes a pair of arcuate abutment members,130, each of which is fixed directly underneath a respective flange 114. More specifically, each abutment member 130 is located and fits in an arcuate internal corner formed between the lower surface of the corresponding flange 114 and the adjacent inner surface of the body wall 111.

Each abutment member 130 includes an arcuate rigid plastic core 131 and a correspondingly shaped resiliently deformable rubber jacket 135 stretched onto and enclosing the core 131. The core 131 has a flat upper surface 132 divided into two equal regions 132A and a partly cylindrical outer surface 133 divided into four equal regions 133A. Each upper surface region 132A includes an integrally upstanding stud 134. The cross-section of the core 131 has an inner edge which is inclined at a small angle downwards and represents the inner surface of the core 131 such that the inner surface is partly conical and tapers upwards.

The jacket 135 is pre-formed with six apertures 136 which have the exact shape, dimension and position as respective surface regions 132A and 133A of the core 131 for exposing them. The exposed surface regions 132A and 133A lie substantially flush with the outer surfaces of the jacket 135, whereby the complete upper and outer surfaces 132 and 133 of the overall abutment member 130, except the studs 134, are substantially flat or smooth. The jacket 135 has, on its inner concave side, a solid surface 137 which, like the inner surface of the core 131, is part-conical and tapers upwards.

Each flange 114 includes a pair of recesses (or holes) 115 on its lower surface, with which respective studs 134 of the corresponding abutment member 130 engage, whereby the abutment member 130 is located. The exposed surface regions 132A and 133A of the core 131 are in contact with the lower surface of the flange 114 and the adjacent inner surface of the body wall 111 respectively, where glue or ultrasonic welding is applied to permanently fix the abutment member 130 in position.

Each abutment member 130 preferably has the same width and arcuate length as the corresponding flange 114 and covers the entire lower surface of the flange 114. The two abutment members 130 together provide, by way of their opposing inner surfaces 137, a generally frusto-conical. surface that is both frictionally gripping and slightly resiliently deformable by nature, for abutment or engagement by the rim portion of the mouth of the wine bottle 10 whose cork 11 is to be removed.

The cork remover 100 is thus engageable with the wine bottle 10 in a manner that is relatively more firmly and stably as a result of the aforesaid frictional gripping and resilient abutment, which considerably reduces the chance of undesirable slipping between the cork remover 100 in operation and the wine bottle 10. Also, by reason of their combined frusto-conical shape, the frictional gripping surfaces 137 are able to cope with wine bottles having mouths of slightly different sizes.

Figure 6:
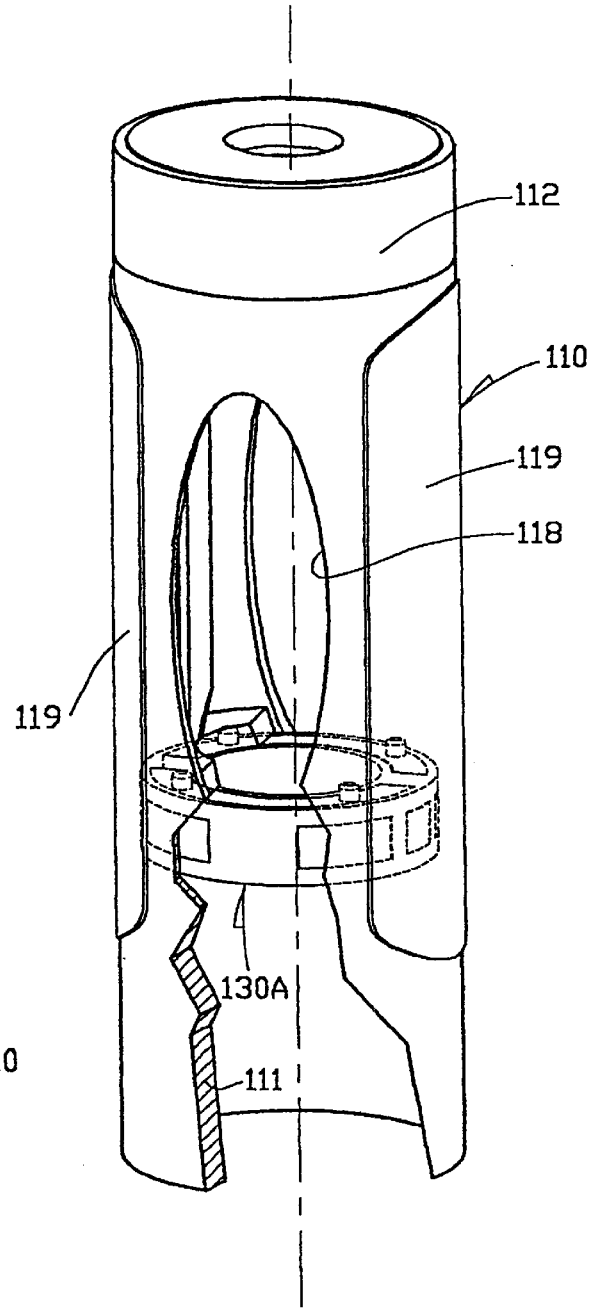
FIG. 6 is a perspective view corresponding to FIG. 3, showing the use of an alternative abutment member in the cork remover.

FIG. 6 shows the remover body 110 incorporating an alternative abutment member 130A, which has a completely annular or ring structure replacing the pair of abutment members 130 described previously. Like the previous abutment members 130, the present abutment member 130A includes a rigid plastic core and a rubberjacket enclosing the core, and is mounted on the lower surfaces of the flanges 114 in the same manner as described above.

The invention has been given by way of example only, and various other modifications of and/or alterations to the described embodiment may be made by persons skilled in the art without departing from the scope of the invention as specified in the appended claims.

What is claimed is:

1. A cork remover for removing the cork of a bottle, the cork remover comprising:

a tubular body having first and second ends, a helical corkscrew with a pointed first end and a second end opposed to the first end, the corkscrew being insertable into the body through the first end of the body for rotation within and relative to the body, and a handle connected to the second end of the corkscrew for rotating the corkscrew, wherein the body includes annular resiliently deformable, frictionally gripping abutment means located in a plane within the body between the first and second ends of the body for engagement of a rim portion of a mouth of a bottle from which a cork is to be removed, the cork being removed by rotation the corkscrew, the abutment means comprising a relatively rigid inner part connected to the body and including a core, and a resiliently deformable outer part for engagement of the rim portion and including a jacket enclosing the core.

2. The cork remover as claimed in claim 1, wherein the jacket includes at least one aperture exposing a part of the core, the part of the core exposed being connected to the body.

3. The cork remover as claimed in claim 2, wherein the core includes a stud inserted in an opening in the body.

4. The cork remover as claimed in claim 2, wherein the part of the core exposed is connected to the body with glue or ultrasonic welding.

5. The cork remover as claimed in claim 4, wherein the part of the core exposed is substantially flush with the jacket around the aperture of the jacket.

6. The cork remover as claimed in claim 2, wherein the part of the core exposed is substantially flush with the jacket around the aperture in the jacket.

7. The cork remover as claimed in claim 1, wherein the body has a tubular wall and includes an integrally formed flange extending radially from an inner surface of the tubular wall, forming a lower internal corner with the tubular wall, and the abutment means is located within the corner.

8. The cork remover as claimed in claim 7, wherein the abutment means is connected to a lower surface of the flange and the inner surface of the tubular wall.

9. The cork remover as claimed in claim 1, wherein the abutment means has a substantially annular tapering inner surface.

10. The cork remover as claimed in claim 9, wherein the inner surface of the abutment means is substantially partially conical.

11. The cork remover as claimed in claim 1, wherein the abutment means comprises a pair of opposed arcuate members.

12. The cork remover as claimed in claim 1, wherein the abutment means is at least partially rubber.

* * * * *